US007053694B2

(12) United States Patent
Ozawa

(10) Patent No.: US 7,053,694 B2
(45) Date of Patent: May 30, 2006

(54) BAND-GAP CIRCUIT WITH HIGH POWER SUPPLY REJECTION RATIO

(75) Inventor: Katsumi Ozawa, Atsugi (JP)

(73) Assignee: Asahi Kasei Microsystems Co., Ltd., Tokyo (JP)

( * ) Notice: Subject to any disclaimer, the term of this patent is extended or adjusted under 35 U.S.C. 154(b) by 30 days.

(21) Appl. No.: 10/921,808

(22) Filed: Aug. 20, 2004

(65) Prior Publication Data

US 2006/0038608 A1 Feb. 23, 2006

(51) Int. Cl.
*G05F 1/10* (2006.01)

(52) U.S. Cl. ..... 327/539; 327/543; 323/313

(58) Field of Classification Search ..... 327/538, 327/539, 541, 542, 543; 323/313
See application file for complete search history.

(56) References Cited

U.S. PATENT DOCUMENTS 4,249,122 A * 2/1981 Widlar ..... 323/313
4,633,165 A * 12/1986 Pietkiewicz et al. ..... 323/314
5,936,391 A * 8/1999 Larsen et al. ..... 323/313
6,005,374 A * 12/1999 Tasdighi ..... 323/273
6,232,828 B1 * 5/2001 Smith et al. ..... 327/539
6,242,897 B1 * 6/2001 Savage et al. ..... 323/313
6,489,835 B1 * 12/2002 Yu et al. ..... 327/539
6,559,629 B1 * 5/2003 Fernald ..... 323/313
6,690,228 B1 * 2/2004 Chen et al. ..... 327/538
6,724,176 B1 * 4/2004 Wong et al. ..... 323/316
6,885,178 B1 * 4/2005 Marinca ..... 323/316
6,954,059 B1 * 10/2005 MacLean ..... 323/316
2002/0070793 A1 * 6/2002 Ochi ..... 327/539

* cited by examiner

*Primary Examiner*—Terry D. Cunningham
(74) *Attorney, Agent, or Firm*—Finnegan, Henderson, Farabow, Garrett & Dunner, L.L.P.

(57) ABSTRACT

A band-gap circuit is constituted by comprising a feedback control amplifier 31 and MOS transistors 32 and 35, having two transistors 33 and 34 of which emitter area is different, comprising resistors $R_1$, $R_2$ and $R_p$ between a base and an emitter of the transistor 33 of which emitter area is smaller, having the resistor $R_p$ between the base and a collector and comprising the resistors $R_1$ and $R_2$ between the base and emitter of the transistor 34 of which emitter area is larger. It is possible to provide the band-gap circuit operable at a low supply voltage and having high PSRR, low noise and few variations.

3 Claims, 3 Drawing Sheets

BAND-GAP CIRCUIT WITH HIGH POWER SUPPLY REJECTION RATIO

FIELD OF THE INVENTION

The present invention relates to a band-gap circuit for generating and outputting a reference voltage, and in particular, to the band-gap circuit of high PSRR, low noise and few voltage variations which outputs the reference voltage of a low voltage proportional to a band-gap voltage and having no temperature dependence so as to allow low supply voltage operation.

BACKGROUND OF THE INVENTION

Conventionally, a band-gap circuit has been known as a circuit for generating a reference voltage having no temperature dependence. The band-gap voltage generated by the band-gap circuit is 1.2 V or so under normal circumstances. However, Japanese Patent Application Laid-Open No. 2002-318626 discloses the band-gap circuit of 0.5V or so as the band-gap circuit operable at low supply voltage. As shown in FIG. 1, it creates, in different circuit blocks, a PTAT (Proportional To Absolute Temperature) current having a characteristic proportional to an absolute temperature at a positive gradient and a CTAT (Complementary To Absolute Temperature) current having a characteristic dependent on the absolute temperature at a negative gradient, respectively. These currents are added to generate the current having no temperature dependency, and the current is passed through a resistance of an output portion so as to convert the current to a voltage and create a low reference voltage having no temperature dependence.

In such a circuit, a current source transistor is operable even in the case of a low supply voltage. In the case of this circuitry, two feedback control amplifiers and five current paths are required.

The band-gap circuit wherein the PTAT current and CTAT current are created in the same current path and the low reference voltage is thereby created with only one feedback control amplifier and three current paths is shown in "Hirofumi Banba et al, 'A CMOS Band-Gap Reference Circuit with Sub 1 V Operation' 1998 Symposium on VLSI Circuits Digest of Technical Papers, p. 228 to 229."

In these conventional techniques, it is necessary to add the PTAT current and CTAT current and pass it through a third current path to convert it from the current to the voltage. The current passing through the third current path is influenced by a change in $V_{DS}$ of a MOS transistor for mirroring the current when the noise from power supply is added. A current value changes due to this influence, and PSRR deteriorates. Therefore, there is a problem that the PSRR and noise characteristic are worse than a typical 1.2 V output band-gap circuit. In addition, there are a large number of current paths, and so the number of elements as a whole increases and the noise and reference voltage variation amounts deteriorate.

An object of the present invention is to provide the band-gap circuit operable at the low supply voltage and capable of generating the low reference voltage, which further has high PSRR, low noise and few reference voltage variations.

SUMMARY OF THE INVENTION

A band-gap circuit of the present invention has a first bipolar transistor, a second bipolar transistor, a first voltage control current source connected to an emitter of the first bipolar transistor, a second voltage control current source connected to the emitter of the second bipolar transistor, a feedback control amplifier for having voltages of the emitter of the first bipolar transistor and the emitter of the second bipolar transistor inputted respectively and controlling the first and second voltage control current sources to equalize emitter voltages of the first and second bipolar transistors, resistor divided into at least two and connected between a base and the emitter of the first bipolar transistor, and resistive elements connected between the base and a collector and between the base and emitter of the second bipolar transistor respectively so as to produce an output from a split node of the resistive element between the base and emitter of the second bipolar transistor.

In the band-gap circuit, emitter area of the second bipolar transistor may be N times (N is a positive integer) the emitter area of the first bipolar transistor.

Furthermore, it is possible to render current ratios of the first and second voltage control current sources different so as to render ratios of the currents passing through the first and second bipolar transistors different.

It is possible, by preparing such a band-gap circuit, to provide the band-gap circuit operable at the low supply voltage and having high PSRR, low noise and few voltage variations.

DETAILED DESCRIPTION OF THE INVENTION

Figure 1:
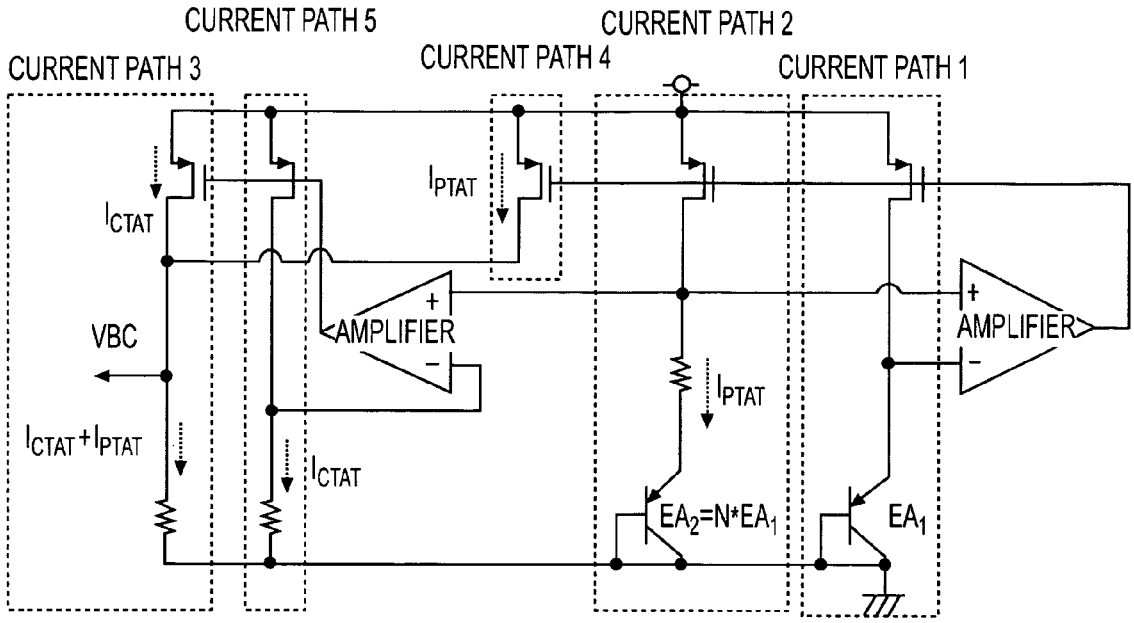
FIG. 1 is a diagram showing a low supply voltage band-gap circuit according to the conventional art.
Figure 2:
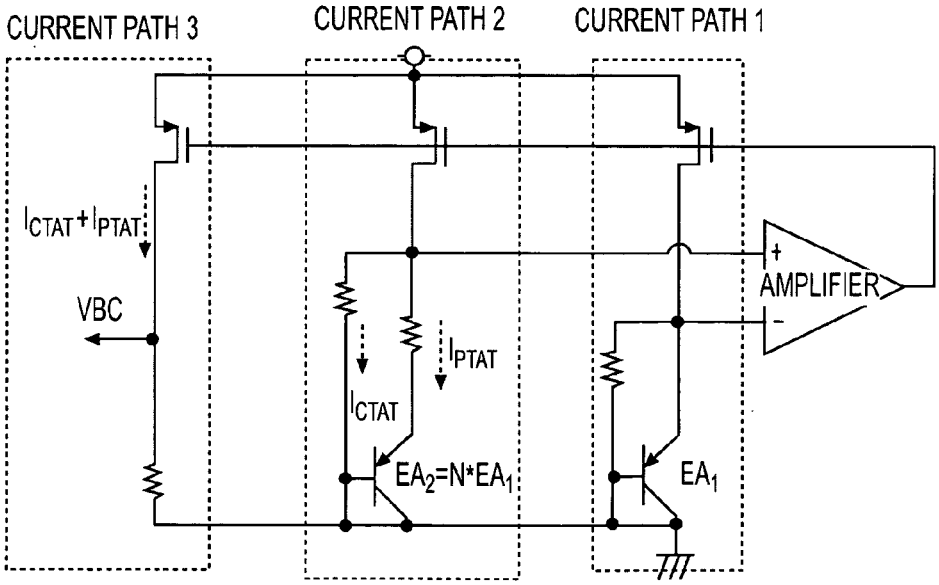
FIG. 2 is a diagram showing the low supply voltage band-gap circuit according to the conventional art.
Figure 3:
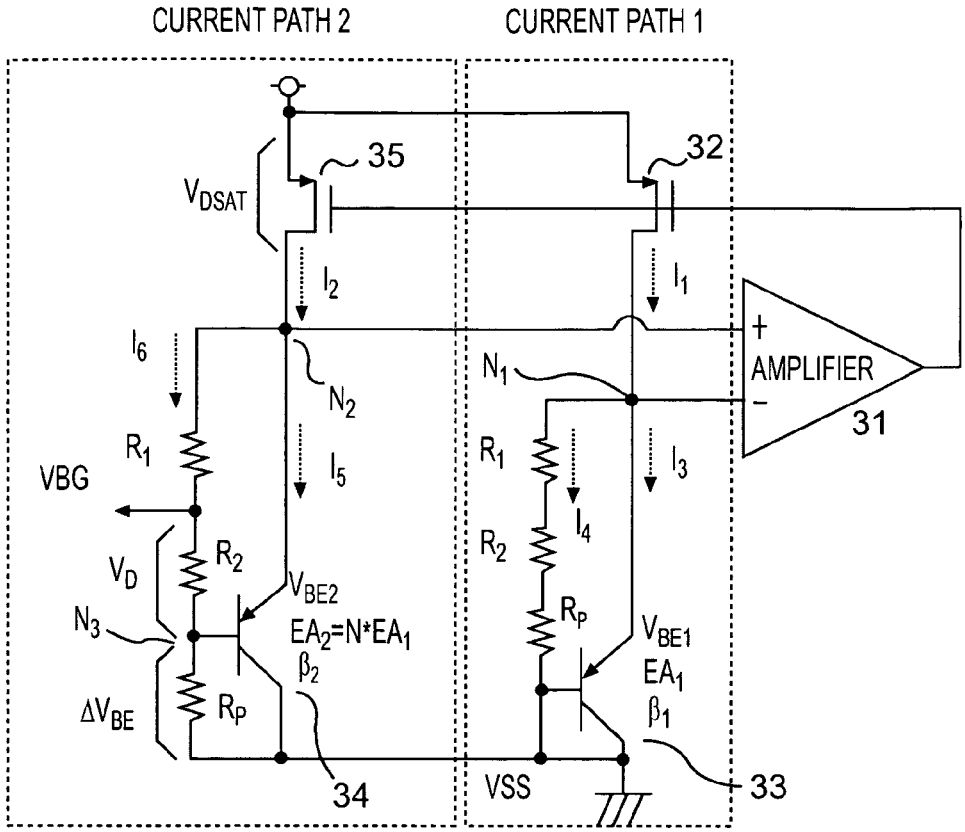
FIG. 3 is a diagram showing a first embodiment of the band-gap circuit according to the present invention.

FIG. 3 is a diagram showing a band-gap circuit according to the present invention, where a current path 1 and a current path 2 are provided between a supply voltage and a ground voltage. The current path 1 is comprised of a PMOS transistor 32 and a bipolar transistor 33, where a source of the PMOS transistor 32 is connected to the supply voltage and a drain of the PMOS transistor 32 is connected to an emitter of the bipolar transistor 33. A collector and a base of the bipolar transistor 33 are connected to a ground potential. Furthermore, a resistor R1, a resistor R2 and a resistor Rp are connected in series between the emitter and base of the bipolar transistor 33.

The current path 2 is comprised of a PMOS transistor 35 and a bipolar transistor 34, where the source of the PMOS transistor 35 is connected to the supply voltage and the drain of the PMOS transistor 35 is connected to the emitter of the bipolar transistor 34. The collector of the bipolar transistor 34 is connected to the ground potential. Furthermore, the resistor $R_1$ and $R_2$ are connected in series between the emitter and base of the bipolar transistor 34. The resistor $R_p$ is connected between the collector and base of the bipolar transistor 34.

The voltage of a connection node $N_1$ between the drain of the PMOS transistor 32 and the emitter of the bipolar transistor 33 in the current path 1 is connected to an inverting input terminal of a feedback control amplifier 31. The voltage of a connection node $N_2$ between the drain of the PMOS transistor 35 and the emitter of the bipolar transistor 34 in the current path 2 is connected to a non-inverting input terminal of the feedback control amplifier 31. Signals outputted from an output terminal of the feedback control amplifier 31 are inputted to gates of the PMOS transistors 32 and 35.

Characteristics of the two MOS transistors 32 and 35 are equal.

The feedback control amplifier 31 controls currents passing through the two current paths so that the potentials of the nodes $N_1$ and $N_2$ become equal. As the voltages between the gates and sources of the two MOS transistors 32 and 35 are constantly equal, currents $I_1$ and $I_2$ passing through the MOS transistors 32 and 35 respectively are constantly equal currents. As the potentials of the nodes $N_1$ and $N_2$ are equal, a voltage difference $\Delta V_{BE}$ between the base and emitter of the bipolar transistors 33 and 34 is the potential of the node $N_3$ and can be represented by a formula (1).

$$\begin{aligned}\Delta V_{BE} &= V_{BE1} - V_{BE2} \\ &= V_T * \ln(I_3/I_5) - V_T * \ln(I_5/(N * I_5)) \\ &= V_T * \ln(N * I_3/I_5)\end{aligned} \tag{1}$$

Here, $V_T$ can be represented as $V_T$=kT/q by using a Boltzmann's constant k, an absolute temperature T and a electronic charge q. $I_S$ is an saturation current of the bipolar transistor, and $I_4$ is the current passing through the resistor connected between the base and emitter of the bipolar transistor 33. $I_5$ is the emitter current of the bipolar transistor 34, and $I_3$ is the emitter current of the bipolar transistor 33, and $I_6$ is the current passing through the resistance connected between the base and emitter of the bipolar transistor 34. Emitter area $EA_2$ of the bipolar transistor 34 is N times the emitter area of the bipolar transistor 33.

Furthermore, $I_1$ is a sum of $I_3$ and $I_4$, $I_2$ is a sum of $I_5$ and $I_6$, and $I_1$=$I_2$ and so a formula (2) holds.

$$I_3+I_4=I_5+I_6 \tag{2}$$

The potentials of the nodes $N_1$ and $N_2$ can be represented by a formula (3) using the currents $I_4$ and $I_6$ passing through the resistance, a base current $I_5/(1+\beta_2)$ of the transistor 34 and the resistance values $R_1$, $R_2$ and $R_p$ respectively. Here, $\beta_2$ is the current gain of the transistor 34.

$$\text{Potential of } N_1\text{: } (R_1+R_2+R_p)\ I_4$$

$$\text{Potential of } N_2\text{: } (R_1+R_2)\ I_6+R_p\ (I_6+I_5/(1+\beta_2)) \tag{3}$$

Furthermore, the potentials of the nodes $N_1$ and $N_2$ are equal, and so a formula (4) holds.

$$(R_1+R_2)\ I_6+R_p\ (I_6+I_5/(1+\beta_2))=(R_1+R_2+R_p)\ I_4 \tag{4}$$

From the formulas (2) and (4), a ratio between $I_3$ and $I_5$ can be represented by a formula (5).

$$I_3/I_5=1+R_p/((R_1+R_2+R_p)\ (1+\beta_2)) \tag{5}$$

Accordingly, $\Delta V_{BE}$ of the formula (1) can be represented by using the formula (5) as in a formula (6).

$$\Delta V_{BE}=V_T*1n\ (N\ (1+R_p/((R_1+R_2+R_p)\ (1+\beta_2)))) \tag{6}$$

This is a PTAT voltage directly proportional to the temperature.

On the other hand, the voltage difference between the nodes $N_2$ and $N_3$ is the voltage $V_{BE2}$ between the base and emitter of the bipolar transistor 34, and is a CTAT voltage which decreases as the temperature increases, as is known in the art. Accordingly, a voltage $V_D$ between output nodes VBG and $N_3$ is the voltage having divided $V_{BE2}$ by using the resistors $R_1$ and $R_2$, which can be represented by a formula (7). This is also the CTAT voltage inversely proportional to the temperature.

$$V_D=V_{BE2}*R_2/(R_1+R_2) \tag{7}$$

An output reference voltage VBG is the voltage having added a potential $V_D$ between the node $N_3$ and VBG which is the CTAT voltage and a potential $\Delta V_{BE}$ Of the node $N_3$ which is the PTAT voltage. The resistors are adjusted to arbitrary resistance values so that the PTAT voltage and the CTAT voltage mutually counteract temperature dependency to output the reference voltage with no temperature dependency. The output reference voltage VBG at this time can be represented by using the formulas (6) and (7) as in the following formula (8), and is capable of outputting a low voltage proportional to a band-gap voltage.

$$\begin{aligned}VBG &= V_D + \Delta V_{BE} = \\ &V_{BE2} * R_2/(R_1+R_2) + V_T * \ln(N(1+R_p/((R_1+R_2+R_p)(1+\beta))))\end{aligned} \tag{8}$$

As is understandable from the formula (8), it is possible to set the reference voltage value at an arbitrary value by changing an emitter area ratio N of a PNP transistor. For instance, according to this embodiment, it is VBG 0.2 V when N=8 and VBG≈0.3 V when N=56.

This circuit outputs the reference voltage from between the node $N_2$ which is stable as being feedback-controlled by an amplifier and a ground potential VSS. Therefore, it is not easily influenced by variations in the supply voltage so that it can improve PSRR in a low-frequency region, for instance, on the order of 30 dB compared to conventional techniques.

Figure 4:
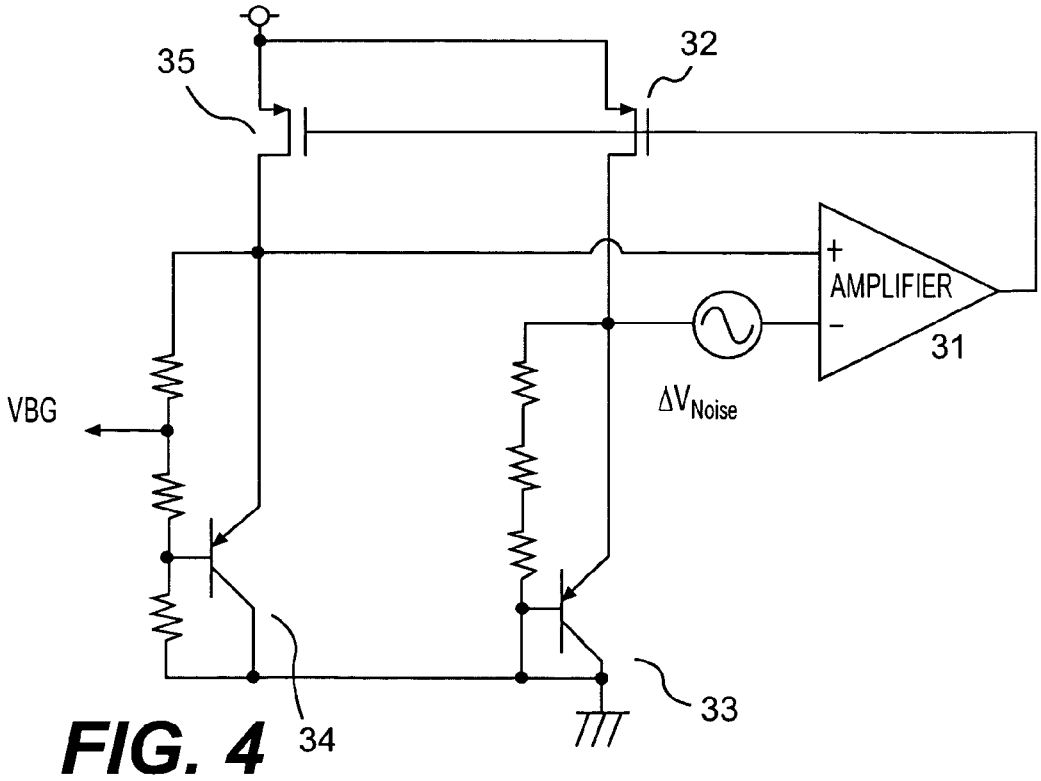
FIG. 4 is a diagram showing the band-gap circuit in the case where noise exists in an input of an amplifier.

Next, consideration is given to influence of noise of the amplifier. As shown in FIG. 4, the output reference voltage VBG can be represented by using the formula (9) by using input-referred noise $\Delta V_{Noise}$. . . . (9)

$$VBG\approx V_{BE2}*R_2/(R_1+R_2)+V_T*1n\ (N\ (1+R_p/((R_1+R_2+R_p)\ (1+\beta))))+\Delta V_{Noise} \tag{9}$$

As is understandable from the formula, a noise component is multiplied by 1 to be added to the VBG. The conventional band-gap circuit has the noise component amplified to a degree of above 1, which shows that the band-gap circuit of the present invention has a low noise characteristic. It is much the same for input-referred offset of the amplifier. The low noise and few variations in the output reference voltage are realized for the above reason and also because the number of the current paths is small and the number of transistors possibly causing the noise and voltage variations is also small.

On the other hand, a minimum supply voltage at which this circuit is operable can be represented by a formula (10) in general since the MOS transistor 32 needs to be operated in a saturation region.

$$VDD>V_{BE1}+V_{DSAT} \tag{10}$$

Here, $V_{DSAT}$ is a drain voltage necessary for the MOS transistors 32 and 35 to operate in the saturation region.

From the formula (10), it is possible to constitute the band-gap circuit capable of operation at the low supply voltage of 1 V or less by using the MOS transistors with a low threshold voltage and the feedback control amplifier 31 capable of operation at the low supply voltage.

From the above, it is possible, by using the potential having divided $V_{BE}$ as the CTAT voltage directly, to generate the low reference voltage having no temperature dependency and proportional to the band-gap voltage only in the two current paths so as to allow the operation at the low supply voltage. To be more specific, it is possible, as no third current path is required, to implement the high PSRR, low noise and few voltage variations.

The example was described as to the case of using a CMOS process. However, it goes without saying that it can also be implemented by using a bipolar process.

Figure 5:
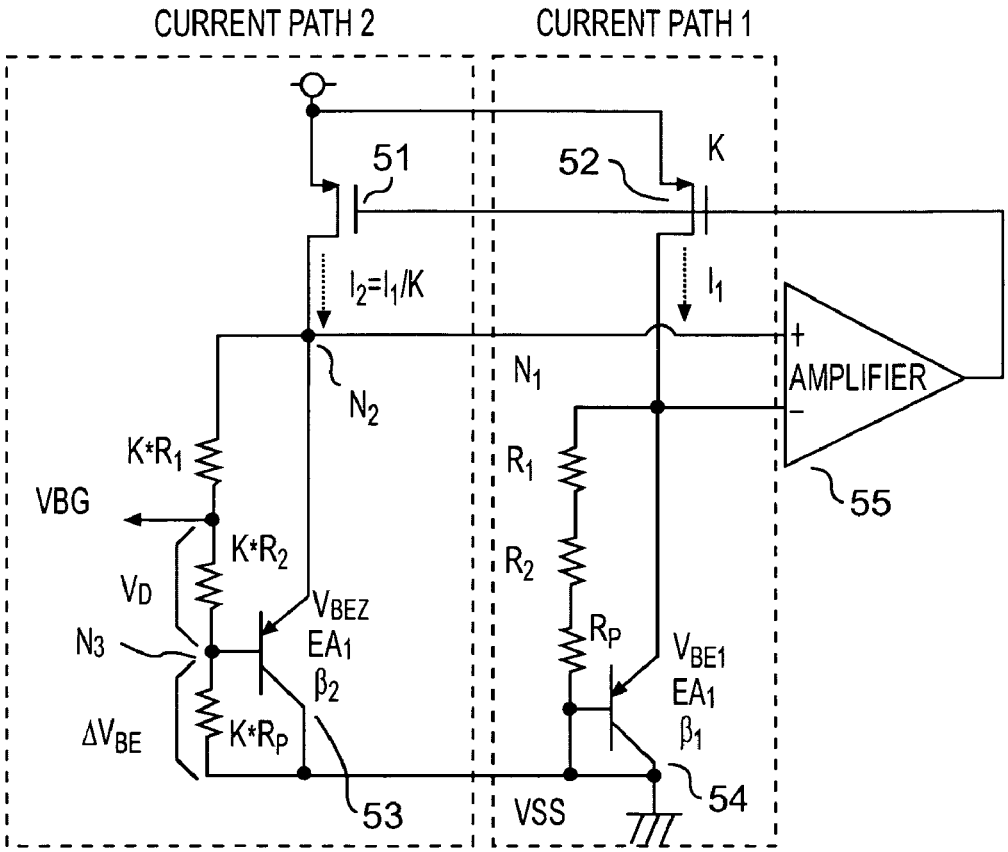
FIG. 5 is a diagram showing a second embodiment of the band-gap circuit according to the present invention.

Next, the embodiment shown in FIG. 5 is different from the circuitry in FIG. 3 in that it is the circuit in which the ratio between gate width W and gate length L (W/L) of a current-source MOS transistor 52 is K times that of a MOS transistor 51 and the emitter area of a bipolar transistor 53 is equal to that of a bipolar transistor 54. If the currents to pass through the two current paths are controlled to equalize the potentials of the nodes $N_1$ and $N_2$, a relationship between the currents $I_1$ and $I_2$ passing through the two MOS transistors 51 and 52 in that case is $I_2=I_1/K$. Therefore, it is possible, by setting the resistances on the bipolar transistor 53 side at values K times those of the resistance values $R_1$, $R_2$ and $R_p$ on the bipolar transistor 52 side, to induce a bias state like the band-gap circuit in FIG. 3 so as to output the low voltage proportional to the band-gap voltage having no temperature dependency as the output reference voltage VBG at this time. The output reference voltage value can be set at an arbitrary value by changing a ratio K between the gate width W and gate length L of the current-source MOS transistor, that is, changing the ratio of the currents passing through the two bipolar transistors.

What is claimed is:

1. A band-gap circuit having:

a first bipolar transistor;

a second bipolar transistor;

a first voltage control current source connected to an emitter of the first bipolar transistor;

a second voltage control current source connected to the emitter of the second bipolar transistor;

a feedback control amplifier for having voltages of the emitter of the first bipolar transistor and the emitter of the second bipolar transistor inputted respectively and controlling the first and second voltage control current sources to equalize emitter voltages of the first and second bipolar transistors;

series first resistors connected between a base and the emitter of the first bipolar transistor; and a second resistor connected between the base and a collector of the second bipolar transistor and series third resistors connected between the base and emitter of the second bipolar transistor respectively, and is characterized by:

producing an output from a node between the series third resistors between the base and emitter of the second bipolar transistor.

2. The band-gap circuit according to claim 1, characterized in that emitter area of the second bipolar transistor is N times (N is a positive integer) the emitter area of the first bipolar transistor.

3. The band-gap circuit according to claim 1, characterized in that current ratios of the first and second voltage control current sources are different and ratios of the currents passing through the first and second bipolar transistors are different.

* * * * *